US011832650B2

(12) United States Patent
Li

(10) Patent No.: US 11,832,650 B2
(45) Date of Patent: Dec. 5, 2023

(54) HEAT-NOT-BURN ELECTRONIC CIGARETTE DEVICE

(71) Applicant: Lingxiao Li, Walnut, CA (US)

(72) Inventor: Lingxiao Li, Walnut, CA (US)

( * ) Notice: Subject to any disclaimer, the term of this patent is extended or adjusted under 35 U.S.C. 154(b) by 370 days.

(21) Appl. No.: 17/122,611

(22) Filed: Dec. 15, 2020

(65) Prior Publication Data

US 2022/0183363 A1 Jun. 16, 2022

(51) Int. Cl.
*A24F 40/46* (2020.01)
*A24F 40/48* (2020.01)
*A24F 7/00* (2006.01)

(52) U.S. Cl.
CPC ..... *A24F 40/46* (2020.01); *A24F 7/00* (2013.01); *A24F 40/48* (2020.01)

(58) Field of Classification Search
CPC ..... A24F 40/00; A24F 40/20; A24F 40/40; A24F 40/42; A24F 40/46; A24F 7/00
See application file for complete search history.

(56) References Cited

U.S. PATENT DOCUMENTS

2021/0015175 A1* 1/2021 Jackson

* cited by examiner

*Primary Examiner* — Michael J Felton
*Assistant Examiner* — Daniel Edward Vakili
(74) *Attorney, Agent, or Firm* — LAW OFFICE OF MICHAEL CHEN; Che Yang Chen

(57) ABSTRACT

In one aspect, a heat not burn electronic cigarette device may include a cap comprising a fixer and a mouthpiece; an air tube coupled to the cap; a connector coupled to the air tube; said connector having an opening and a connector cap removably covering the opening; a heating tube coupled to the connector; and a cigarette unit inserted into the heating tube, wherein cigarette smoke is generated from the cigarette unit when heated by the heating tube, and the cigarette smoke can then pass through an airway including the connector, the air tube, the fixer and the mouthpiece. In one embodiment, a diameter of the opening is ½ to ⅓ of a height of the connector.

10 Claims, 4 Drawing Sheets

HEAT-NOT-BURN ELECTRONIC CIGARETTE DEVICE

FIELD OF THE INVENTION

The present application generally relates to electronic cigarettes, and more particularly, to a heat not burn electronic cigarette device, or a non-combusted cigarette device.

BACKGROUND OF THE INVENTION

Most of the heat-not-burn electronic cigarette devices, or non-combusted cigarette device have the opened airway. Users would have to take off either the top cap or the bottom cap to do their maintenance when a cigarette is broken inside the device, or their is heavy carbon build-up on the heating component. The opening is usually on the opposite end of the cigarette inlet. Although the above structure is a simple orientation, there are still some disadvantages:

The opening is at top: in most of heat not burn electronic cigarette devices, the opening is at the top. However, the tobacco or carbon would gather around the opening and forms liquid drops. In addition, the sealing could be easy to leak since the hot vapor rises vertically. Once the sealing is loose, vapor and liquid will permeate out of the airway, causing damage to electronic components.

The opening is at bottom: it means that the cigarette is inserted from the top. However, users may have to either use the cigarette filter as mouth-piece since the cigarette filters are proved as not being capable of standing the temperature of heat-not-burn process, or cut the filter off every time when they insert the cigarette, which is not a user-friendly using experience.

The openings are at both top and bottom: in this case, the openable components are too close to the heating components. In the long term, high temperature may make the parts aging faster, increasing the possibility of deformation or break. Therefore, there is still a need for a heat not burn electronic cigarette device to provide an improved quality and solve the problem caused from the top and/or bottom opening.

SUMMARY OF THE INVENTION

The present application discloses a heat not burn electronic cigarette device, or a non-combusted cigarette device to provide an improved quality and solve the problem caused from the top and/or bottom opening.

The heat not burn electronic cigarette device comprises a cap, an air tube, a connector and a heating tube. The cap may include a mouthpiece, the air tube is coupled to the cap, the connector is coupled to the air tube, and the heating tube is coupled to the connector.

In various exemplary embodiments, the connector may include an opening and a connector cap removably covering the opening. A diameter of the opening is ½ to ⅓ of a height of the connector.

In various exemplary embodiments, wherein the cap further comprises a fixer, the mouthpiece is coupled to the fixer. The fixer comprises at least one latching member. More specifically, the fixer comprises three latching members.

In various exemplary embodiments, wherein the cap further comprises a fixer, the mouthpiece is coupled to the fixer. The fixer comprises a recess, the mouthpiece is located inside the recess. More specifically, the recess comprises a same shape as the mouthpiece.

In various exemplary embodiments, wherein the connector comprises a base and a plug, and the base is coupled to the heating tube while plug is coupled to the base. In one embodiment, the plug comprises a plate and an insert that is coupled to the plate and is inserted into the base.

Based on the above, the present application provides a heat not burn electronic cigarette device with a side opened airway, allowing the user to clean the airway while couple the charger to the cap and the connector at the same time. Specifically, the opening of the connector allows the user to clean the airway while the top and bottom end are sealed. Users just need to remove the connector cap and insert the cleaning brush into the opening and it will reach the whole inner surface area of the airway and the heating tube.

Although there still may be a small amount of liquid drops will go to the airway, the liquid drops will be easily cleaned. As such, the side-opened airway design of the connector of the heat not burn electronic cigarette device has solved the leaking and aging problem.

Numerous other advantages and features of the present application will become readily apparent from the following detailed description of disclosed embodiments, from the claims and from the accompanying drawings.

BRIEF DESCRIPTION OF THE DRAWINGS

The objects, features and advantages of the present application will be more readily appreciated upon reference to the following disclosure when considered in conjunction with the accompanying drawings, wherein like reference numerals are used to identify identical components in the various views, and wherein reference numerals with alphabetic characters are utilized to identify additional types, instantiations or variations of a selected component embodiment in the various views, in which.

DETAILED DESCRIPTION OF DISCLOSED EMBODIMENTS

Figure 1:
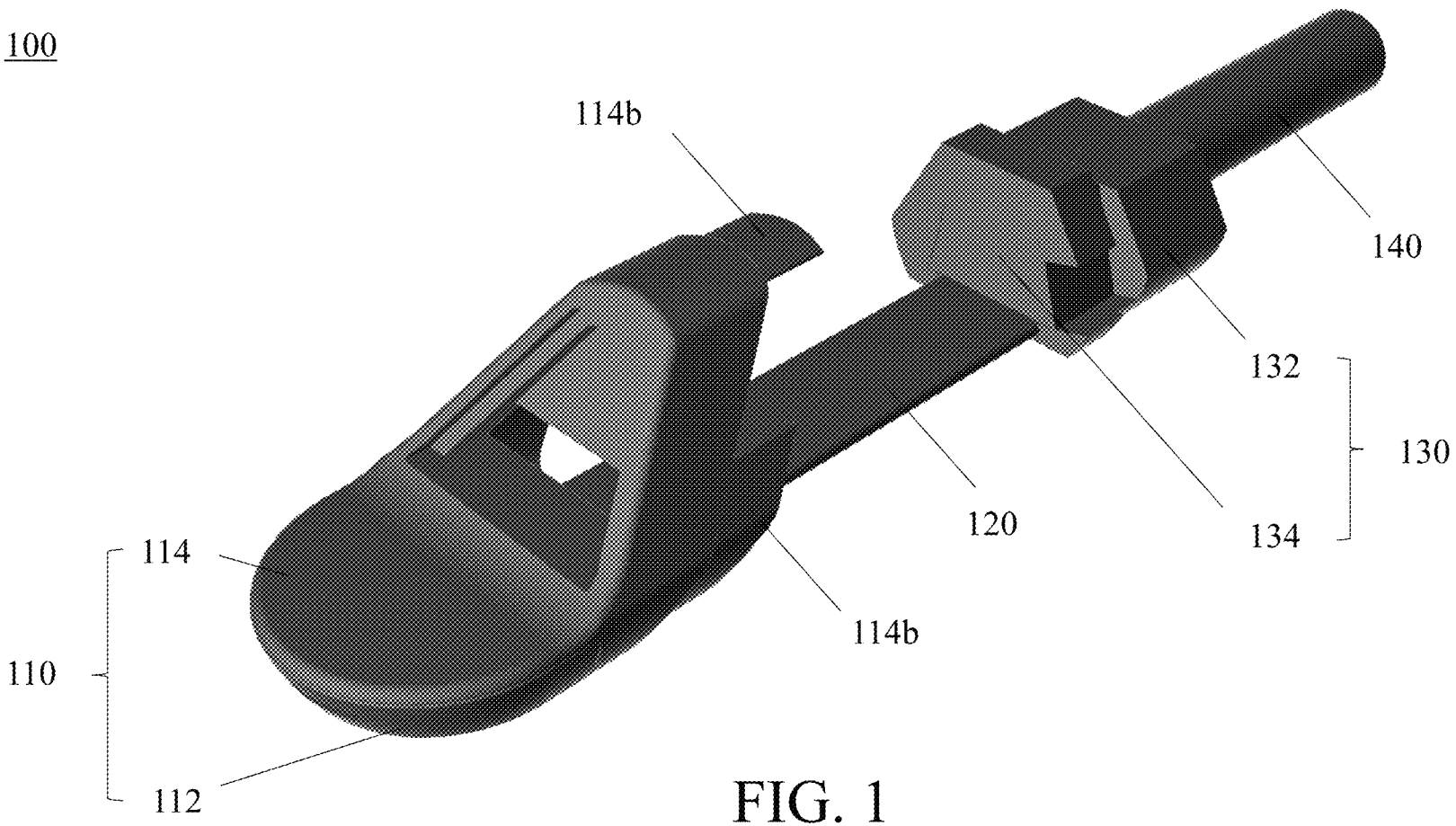
FIG. 1 is a perspective view of a heat not burn electronic cigarette device.

Reference will now be made in detail to the present representative embodiments of the present application, examples of which are illustrated in the accompanying drawings. Wherever possible, the same reference numbers are used in the drawings and the description to refer to the same or like parts.

Figure 2:
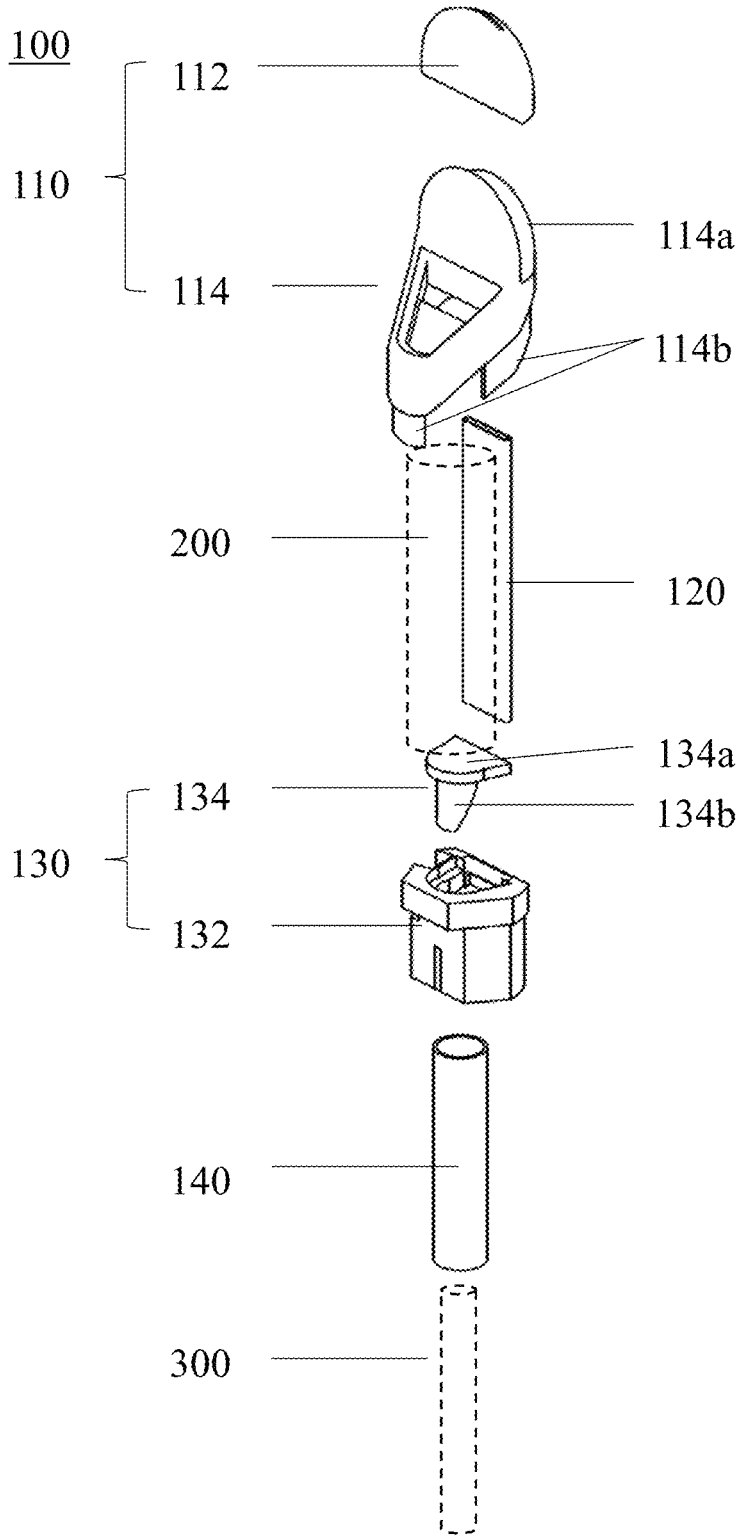
FIG. 2 is an explosive view of the heat not burn electronic cigarette device.

FIG. 1 is a perspective view of a heat not burn electronic cigarette device 100, and FIG. 2 is the explosive view of the heat not burn electronic cigarette device 100. Referring to FIGS. 1-2, the heat not burn electronic cigarette device 100 comprises a cap 110, an air tube 120, a connector 130 and a heating tube 140. In one embodiment, the cap comprises a mouthpiece 112 and a fixer 114. The fixer 114 comprises a recess 114*a* and at least one latching member 114*b*, and the recess 114*a* and the mouthpiece 112 are of the same shape, so the mouthpiece 112 can be inserted into the recess 114*a*.

It is noted that the shape of the recess 114*a* is not limited to the shape disclosed in the present invention.

The fixer 114 of the present application may include a plurality of latching members 114*b*, and two of the latching members 114*b* are located at left side and right side of the fixer 114 while the last one of the latching member 114*b* is located at the front side of the fixer 114. It is noted that the location and the amount of the latching member 114*b* are not limited as shown in FIGS. 1 and 2, as long as the latching member 114*b* can secure a battery 200 at the specific location. In one embodiment, the air tube 120 is hollow and is coupled between the cap 110 and the connector 130.

Figure 3:
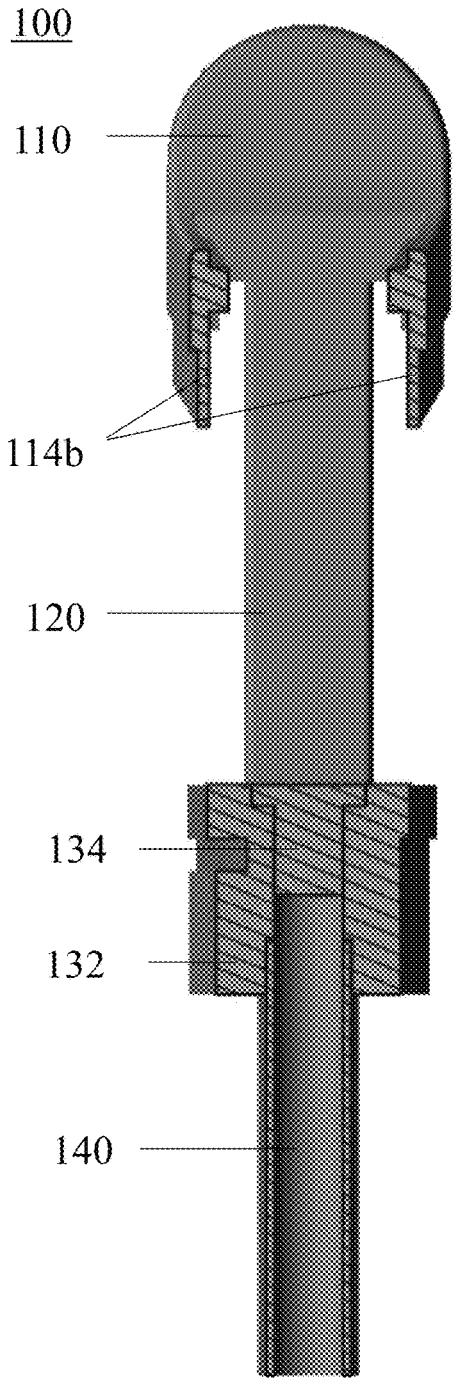
FIG. 3 is a cross-sectional view of the heat not burn electronic cigarette device through a first direction plane.
Figure 4:
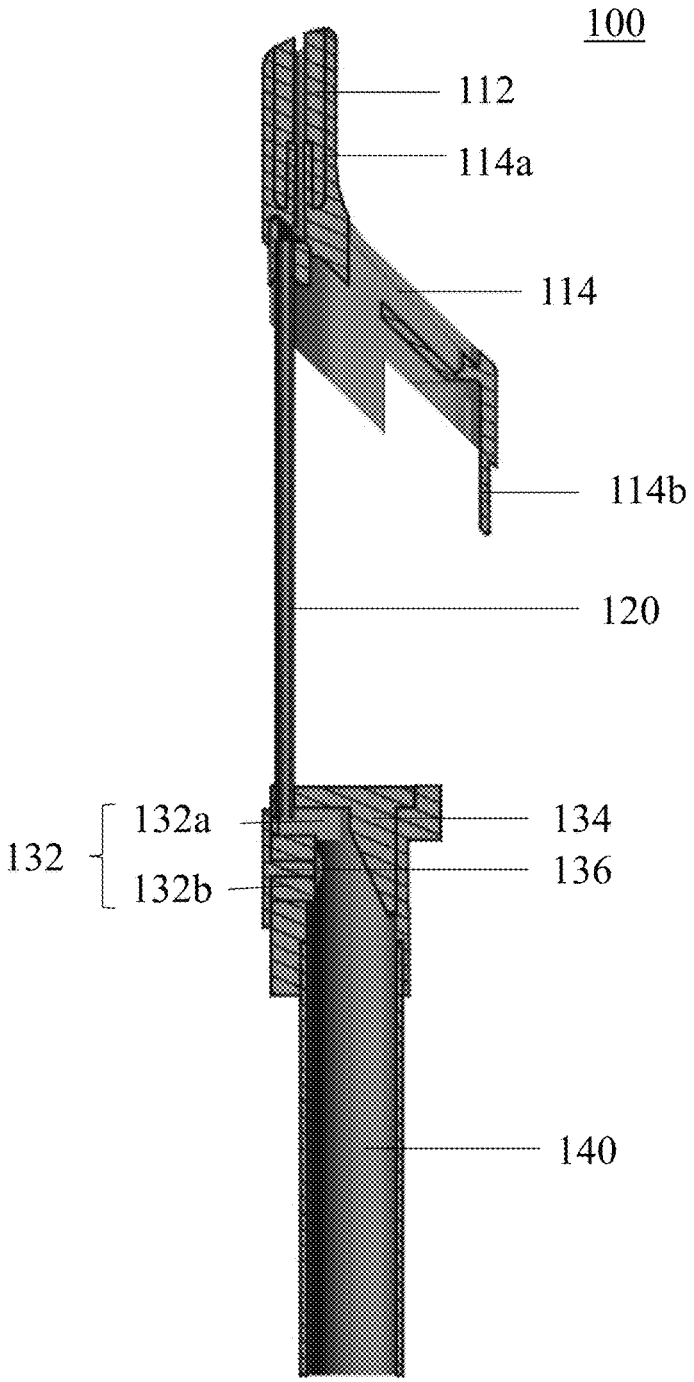
FIG. 4 is a cross-sectional view of the heat not burn electronic cigarette device through a second direction plane.
Figure 5:
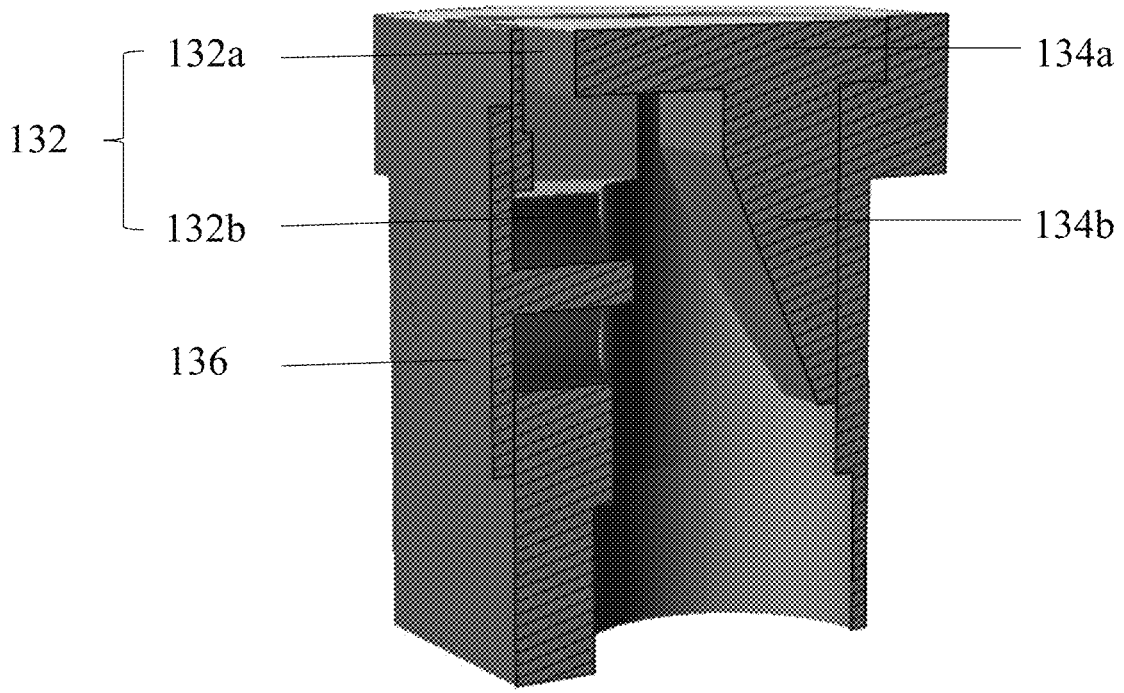
FIG. 5 is a cross-sectional view of the connector of the heat not burn electronic cigarette device through the second direction plane.

FIG. 3 is a cross-sectional view of the heat not burn electronic cigarette device 100 through a first direction plane. FIG. 4 is a cross-sectional view of the heat not burn electronic cigarette device 100 through a second direction plane. FIG. 5 is a cross-sectional view of the connector 130 of the heat not burn electronic cigarette device 100 through the second direction plane.

Referring to FIGS. 1-5, the cap 110 and the connector 130 define an accommodation space for the charger 200. In one embodiment, the charger 200 is a battery. However, the present application is not limited thereto, the heat not burn electronic cigarette device 100 can also be charged through multiple ways, such as USB.

In a further embodiment, the connector 130 may include a base 132, a plug 134 and a connector cap 136. The base 132 comprises a first opening 132*a* and a second opening 132*b*. The first opening 132*a* is configured to couple the plug 134 and the heating tube 140, while the second opening 132*b* is configured to allow the connector cap 136*b* to be removably coupled.

The plug 134 comprises a plate 134*a* and an insert 134*b*. The charger 200 is coupled to the plate 134*a*. That is to say, the plate 134*a* of the plug 134 supports the charger 200. The insert 134*b* is inserted into the base 132 for fixing the plug 134 is a specific location.

The connector cap 136 removably covers to the second opening 132*b*. Specifically, a diameter of the second opening 132*b* is ½ to ⅓ of a height of the base 132 of the connector 130. A diameter of the connector cap 136 is larger than the diameter of the second opening 132*b*.

The heating tube 140 is configured to accommodate a cigarette unit 300. More specifically, the cigarette unit 300 for heat not burn electronic cigarette device 100 can be inserted into the heating tube 140 and removed after heating.

By the structure stated above, the cigarette smoke generated by the heat not burn electronic cigarette device in the present invention is from the cigarette unit 300 heated by the heating tube 140, and the smoke can then pass through an airway including the connector 130, the air tube 120, the fixer 114, and eventually to the mouthpiece 112.

In summary, the present application provides a heat not burn electronic cigarette device with a side opened airway, allowing the user to clean the airway while couple the charger to the cap and the connector at the same time. More specifically, the opening of the connector allows the user to clean the airway while the top and bottom end are sealed. Users just need to remove the connector cap and insert the cleaning brush into the opening and it will reach the whole inner surface area of the airway and the heating tube.

Although there still may be a small amount of liquid drops will go to the airway, the liquid drops will be easily cleaned. As such, the side-opened airway design of the connector of the heat not burn electronic cigarette device has solved the leaking and aging problem. In addition, the side-opened airway structure may also solve the problem of stagnant water.

It will be apparent to those skilled in the art that various modifications and variations can be made to the structure of the present application without departing from the scope or spirit of the present application. In view of the foregoing, it is intended that the present application cover modifications and variations of this application provided they fall within the scope of the following claims and their equivalents.

What is claimed is:

1. A heat-not-burn electronic cigarette device, comprising:

a cap comprising a fixer and a mouthpiece; said fixer comprising one or more latching members;

an air tube coupled to the cap;

a connector coupled to the air tube; said connector having an opening and a connector cap removably covering the opening;

a heating tube coupled to the connector; and a cigarette unit inserted into the heating tube, wherein cigarette smoke is generated from the cigarette unit when heated by the heating tube, and the cigarette smoke can then pass through an airway including the connector, the air tube, the fixer and the mouthpiece.

2. The heat-not-burn electronic cigarette device as claimed in claim 1, wherein the fixer comprises a recess, and the mouthpiece is received in the recess.

3. The heat-not-burn electronic cigarette device as claimed in claim 2, wherein the recess and the mouthpiece are of the same shape.

4. The heat-not-burn electronic cigarette device as claimed in claim 1, wherein the connector comprises a base coupled to the heating tube, and a plug coupled to the base.

5. The heat-not-burn electronic cigarette device as claimed in claim 4, wherein the plug comprises a plate, and an insert coupled to the plate and inserted into the base.

6. The heat-not-burn electronic cigarette device as claimed in claim 1, wherein the fixer comprises one or more latching members.

7. The heat-not-burn electronic cigarette device as claimed in claim 1, wherein the fixer comprises a recess, and the mouthpiece is received in the recess.

8. The heat-not-burn electronic cigarette device as claimed in claim 7, wherein the recess and the mouthpiece are of the same shape.

9. The heat-not-burn electronic cigarette device as claimed in claim 1, wherein the connector comprises a base coupled to the heating tube, and a plug coupled to the base.

10. The heat-not-burn electronic cigarette device as claimed in claim 9, wherein the plug comprises a plate, and an insert coupled to the plate and inserted into the base.

* * * * *